United States Patent [19]

Hyland

[11] 4,004,596

[45] Jan. 25, 1977

[54] HAIR STYLING IMPLEMENT

[75] Inventor: Francis B. Hyland, Scituate, Mass.

[73] Assignee: The Gillette Company, Boston, Mass.

[22] Filed: Mar. 3, 1975

[21] Appl. No.: 555,077

[52] U.S. Cl. ..... 132/37 R; 132/9; 219/222; 219/225; 219/241; 219/273; 219/275

[51] Int. Cl.² ..... A45D 2/24

[58] Field of Search ..... 219/222, 225, 271, 272, 219/273, 274, 275; 132/11, 33, 32, 37

[56] References Cited

UNITED STATES PATENTS

| | | | |
|---|---|---|---|
| 2,254,266 | 9/1941 | Cannon | 132/37 R |
| 3,559,658 | 2/1971 | Genest | 132/33 R |
| 3,665,939 | 5/1972 | Laing | 132/33 R |
| 3,766,930 | 10/1973 | Madsen | 132/33 R |
| 3,835,292 | 9/1974 | Walter | 219/225 |

*Primary Examiner*—G.E. McNeill

*Attorney, Agent, or Firm*—Richard A. Wise; Oistein J. Bratlie; Donald E. Mahoney

[57] ABSTRACT

A vapor generating hair styling implement is arranged to style hair in contact with a portion of a tubular body uniformly heated by an internally disposed electrical heating assembly having a spacer arranged to contact the tubular body at predetermined points.

6 Claims, 9 Drawing Figures

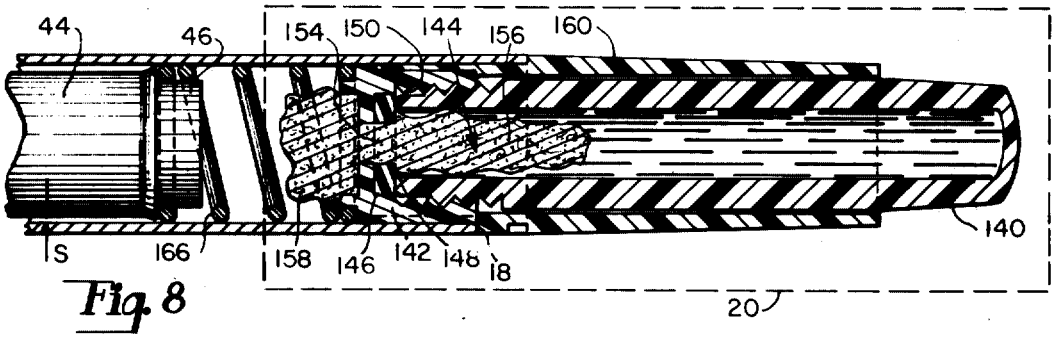
Fig. 8
Fig. 9
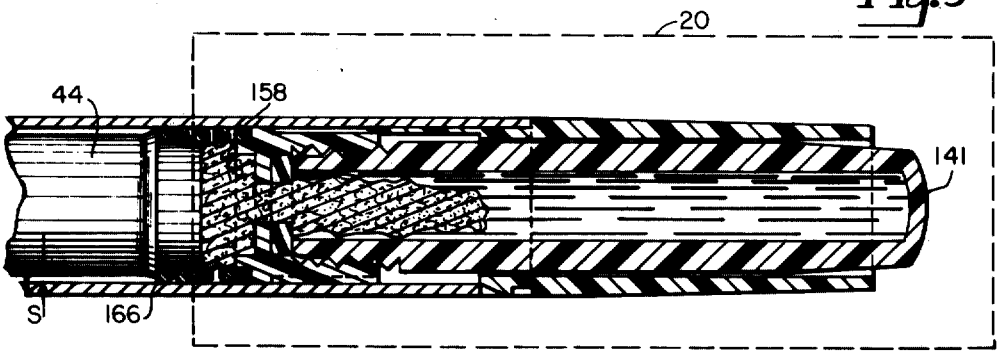
Fig. 7
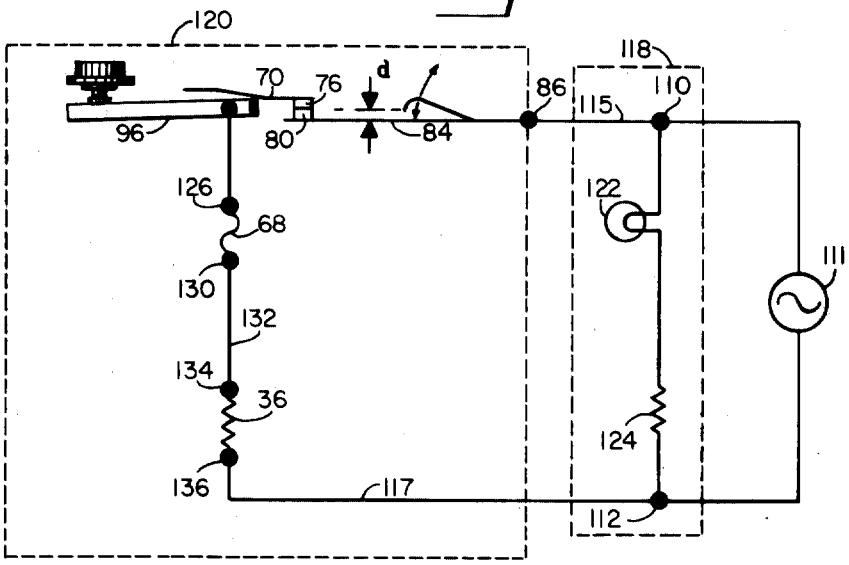

HAIR STYLING IMPLEMENT

BACKGROUND OF THE INVENTION

1. Field of the Invention

This invention relates to curling irons and, more particularly, to steam generating curling irons having a uniformly heated hair styling surface.

2. Description of the Prior Art

It is well known to use steam for curling hair. In the prior art, a dry tress of hair is wound about the surface of a heated tubular curling iron having apertures for dispensing a metered quantity of steam. The steam supplies sufficient moisture to plasticize the wound hair for initially forming a curl. The moistened hair is in contact with the heated curling iron surface for about 5 to 15 seconds. The heated curling iron surface removes the supplied moisture from the hair to fix a hair curl. One example of an electrically heated curling iron arranged to dispense a metered quantity of steam for curling a tress of hair is described in U. S. Pat. No. 3,835,292, "Steam Curling Iron," issued to Henry J. Walter et al on Sept. 10, 1974.

A problem frequently encountered by users of prior art curling irons is an uneven curl caused by a tress of hair containing a curling iron surface having a temperature gradient. The surface temperature at the center of a prior art curling iron is usually higher than the surface temperature at the curling iron extremities. Thus, it will be appreciated that hair in contact with the center of a prior art curling iron will dry before hair in contact with the extremities of a prior art curling iron resulting in an uneven curl.

SUMMARY OF THE INVENTION

According to the present invention, a hair styling apparatus comprises a first tubular member having a hair styling portion with first and second ends and a plurality of apertures there between. A second tubular member having nodules uniformly arranged about a peripheral surface is disposed within the first tubular member. The nodules contact predetermined points on the first tubular member to provide a uniform, predetermined spacing between the first and second members and to transfer heat by conduction from the second member to the predetermined points on the first member. A heat reservoir means is attached to one end of the second tubular member. Heat generating means is disposed within the second tubular member in heat transfer contact with the heat reservoir means and the second tubular member for heating the hair styling portion to a predetermined uniform temperature. A variable temperature control means is coupled to the heat generating means for maintaining the hair styling portion at the predetermined temperature. A handle is mounted on one end of the first tubular member and fluid dispensing means is mounted on a first tubular member end opposite the handle. The fluid dispensing means supplies a predetermined amount of fluid to the heat reservoir means for vaporization, whereby the vaporized fluid is discharged in a radial direction through the apertures. Clamping means are pivotally mounted on the handle to clamp hair against the hair styling portion of the first tubular member.

BRIEF DESCRIPTION OF THE DRAWINGS

FIG. 7 is a schematic diagram of electrical wiring for the hair styling implement.

FIGS. 8 and 9 are broken sectional drawings of a fluid dispensing assembly.

DESCRIPTION OF THE PREFERRED EMBODIMENT

Figure 1:
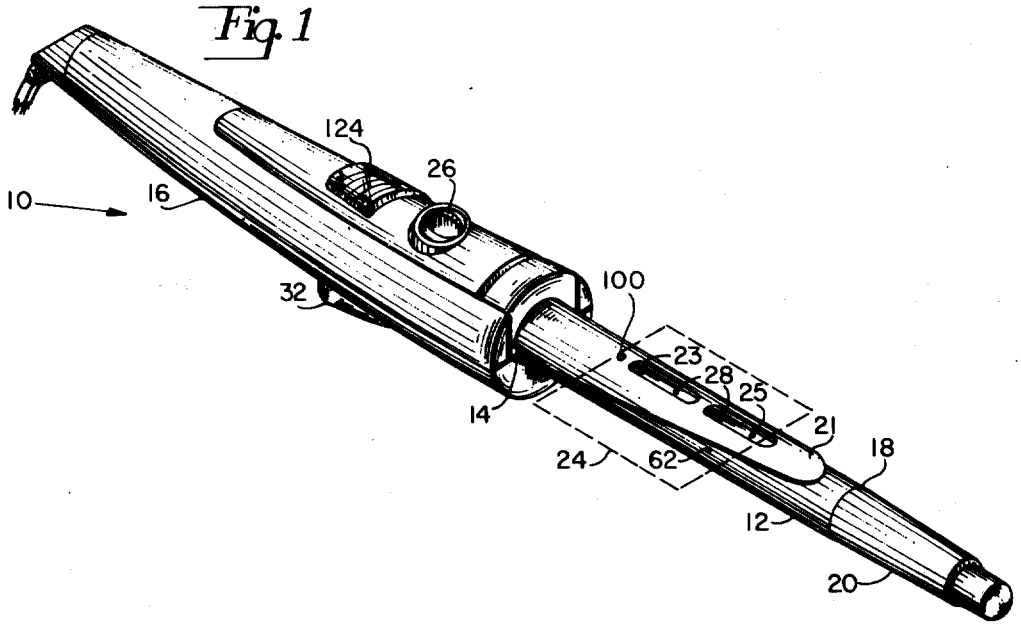
FIG. 1 is a perspective view of a hair styling implement according to the invention.

Referring to FIG. 1, there is shown a perspective view of a hair styling implement 10 according to the present invention including a tube-like heat conducting styling member 12 having one end 14 attached to a handle 16 and an opposite end 18 attached to a fluid dispensing assembly 20. Styling member 12 is arranged to be in heat transfer contact with an internally disposed electrical heating assembly 22, shown in FIG. 2 and described below. Heat transfer from styling member 12 to handle 16 and fluid dispensing assembly 20 is minimized by forming member 12 from material having a relatively low thermal conductivity, such as stainless steel. Handle 16 and fluid dispensing assembly 20 is formed from heat resistant material, such as polycarbonate.

The electrical heating assembly 22 is responsive to electrical current and arranged to generate sufficient heat to uniformly maintain the outer surface 62 of a perforated portion 24 of styling member 12 between apertures 23 and 25 at a temperature determined by a setting of variable temperature control knob 26. The perforations or apertures 23, 25 and 28 in styling member 12 are suitable for discharging a predetermined amount of vapor in a radial direction. A fixed amount of vaporizable fluid from fluid dispensing assembly 20 is converted to a vapor in response to heat generated by heating assembly 22.

Figures 2, 3, 4, 5:
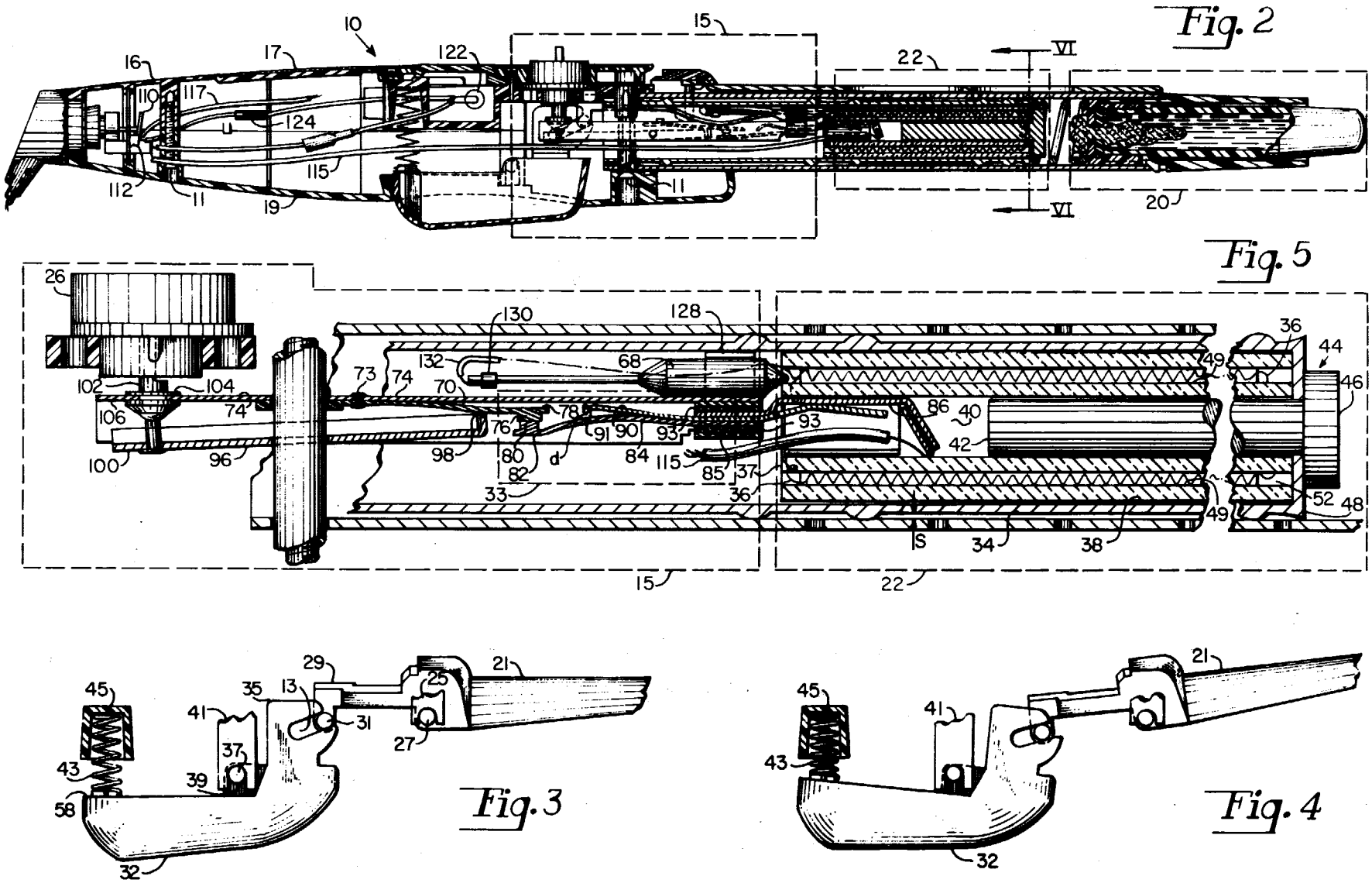
FIG. 2 is a longitudinal sectional view of the hair styling implement of FIG. 1.
FIGS. 3 and 4 are more detailed drawings of a button and clip assembly.
FIG. 5 is a broken sectional drawing of an electrical heating assembly used in the hair styling implement.

Hair is clamped against portion 24 of styling member 12 by a clamping assembly comprising a slotted clip 21 of heat conducting material having a curvature conforming to the shape of styling member 12 and a button 32 attached to clip 21 and pivotally connected to handle 16. Button 32 is biased by a spring 43, shown in FIG. 3, so that clip 21 is normally in a closed position or in friction contact with styling member 12. Button end 58 is depressed into an opening in handle 16 to compress spring 43 and raise clip 21 away from styling member 12, as shown in FIG. 4. A tress of hair inserted between member 12 and clip 21 is clamped against member 12 when button 32 is released.

Referring to FIG. 2, there is shown a longitudinal sectional view of the hair styling implement 10 of FIG. 1, including electrical heating assembly 22, fluid dispensing assembly 20, handle 16 and temperature control assembly 15. Handle 16 has an upper member 17 and a lower member 19 secured together by suitable means such as screws 11 or adhesive to form a housing for temperature control assembly 15 and associated electrical wiring, described below.

Referring to FIGS. 3 and 4, there is shown a more detailed side view of button 32 and clip 21. A first pair of cylindrical pivot members 27 on clip 21 are received in slots 25 in upper handle member 17. Clip 21 has a second pair of cylindrical pivot members 31 formed on clip end 29. The second pair of pivot members 31 on clip 21 are received in slots 13 on button end 35. A pair of cylindrical pivot members 37 are formed on button 32. The button pivot members 37 are received in slots 39 in strut members 41 attached to upper handle member 17. Spring 43 is coupled between button end 58 and a well 45 formed in upper handle member 17 to bias clip 21 against styling member 12. Thus, when button end 58 is depressed into handle 16, button 32 acts as a lever for pivoting clip 21 away from styling member 12 in a direction transverse to the longitudinal axis of styling member 12, as shown in FIG. 4.

Figure 6:
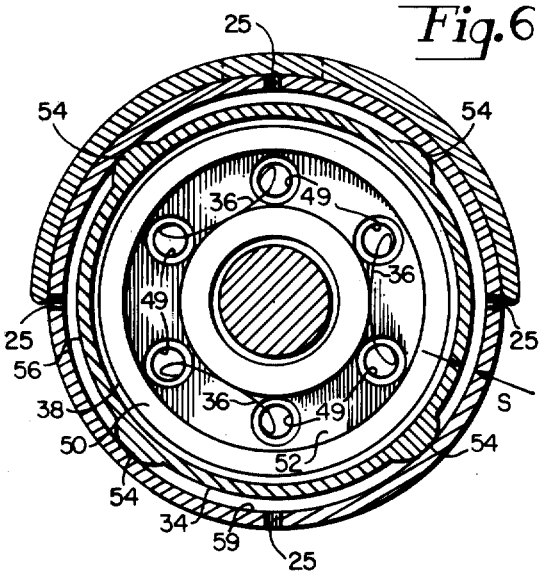
FIG. 6 is a cross sectional drawing of the hair styling implement shown in FIG. 2.

Referring to FIG. 5, there is shown a broken section of the electrical heating assembly 22 and the variable temperature control assembly 15. The electrical heating assembly 22 includes a heat conducting tube-like spacer 34 in heat transfer contact with an electrical insulator 38 housing resistance wire 36. Insulator 38 is an open-ended cylinder formed from heat conducting material, such as ceramic, with a bore 40 suitable for receiving the shank 42 of a heat reservoir 44 or metal slug. The head 46 of heat reservoir 44 is welded or brazed to end 48 of spacer 34. Heat is generated by conventional resistance wire 36 in response to an electrical current signal. Resistance wire 36 is disposed within a plurality of holes 49 in wall 50 of insulator 38 and in a circular recess 52 at each end of insulator 38, as shown in FIG. 6. To protect resistance wire 36 from possible short circuits and moisture, the recess 52 at each end of insulator 38 is sealed by a ring, not shown, of high temperature moisture resistant material, such as silicone rubber. Insulator 38 is disposed within spacer 34 so that shank 42 is received in bore 40 to facilitate heat transfer from resistance wire 36 to spacer 34 and heat reservoir 44.

Conventional curling irons transfer heat by radiation and conduction from a heating assembly to a styling member in contact with a tress of hair. Typically the operating surface temperature of a conventional styling member is relatively higher at the center and lower at the ends which will unevenly curl a tress of hair. Unlike prior art curling irons, the outer surface 62 of portion 24 of styling member 12 is operated at a predetermined uniform temperature by providing point contact between heating assembly 22 and predetermined points on styling member inner surface 59. It is preferred to arrange heating assembly 22 to provide contact with inner surface 59 at points located substantially in the vicinity of apertures 23 and 25 of styling member portion 24.

Referring to FIG. 6, there is shown a cross-section taken along the line 6—6 of FIG. 2, illustrating a plurality of nodules 54 or raised surfaces formed on spacer outer surface 56 to provide point contact between styling member inner surface 59 and spacer 34 when heating assembly 22 is disposed within styling member 12. The nodules 54 are arranged in predetermined rows and columns about the periphery of spacer 34 to determine a uniform spacing, S, between spacer outer surface 56 and styling member inner surface 59. The spacing, S, is selected to provide a desired amount of heat transfer by radiation from spacer 34 to styling member 12. For example, when spacer member 34 is heated to be within a range of 130° C to 140° C, the surface temperature of styling portion 12 is within a range of 110° C to 120° C, when the spacing S is 0.020 inches. The number of nodules are determined empirically for providing sufficient heat transfer by conduction to points located in the vicinity of apertures 23 and 25. It has been determined that heat transfer by conduction to eight points arranged in two rows and four columns in the vicinity of apertures 23 and 25 will maintain portion 24 at a uniform surface temperature.

The variable temperature control assembly 15, shown in FIG. 5, is arranged to cooperate with heating assembly 22 to provide a selected surface temperature for styling member portion 24 suitable for drying and styling different hair conditions, as described below. Means for controlling heat generated by resistance wire 36 includes a suitable variable thermostat 33 for regulating current conduction through thermal fuse member 68 and resistance wire 36 as a function of insulator 38 surface temperature. Thermal fuse member 58 is a conventional device arranged to disrupt current flow to resistance wire 36 to the event thermostat 33 should fail to operate when the surface temperature of insulator 38 exceeds a desired magnitude.

An example of a variable thermostat 33 comprises a first spring metal member 70 having a first end 73 connected to a bracket 74 and a second end 78 connected to a first breaker point 76. Member 70 is arranged to provide electrical and frictional contact between breaker point 76 and a second breaker point 80 connected to end 82 of a second spring metal member 84. A tubular shaped electrical terminal 86 is disposed within bore 40 at end 37 of insulator 38. Terminal 86 is tubular shaped to provide close mechanical contact with insulator 38. A clamp 85 surrounding a sleeve 93 of electrically insulating material, such as fiberglass, fastens a bimetallic element 90 to terminal 86 and member 84. A second clamp 128 attaches fuse member 68 to bracket 74. Sleeve 93 electrically insulates element 90 and member 84 from bracket 74. Heat generated by resistance wire 36 is transferred by conduction from insulator 38 to member 84 and bimetallic element 90 via terminal 86.

Bimetallic element 90 is a conventional temperature sensitive device usually formed of two strips of metal with different coefficients of thermal expansion bound together in such a way that the internal strains caused by temperature changes bend the compound strip. For example, at a given insulator 38 surface temperature, $T_1$, bimetallic element 90 distorts and element end 91 moves a predetermined distance from an initial position at room temperature. An increase in insulator 38 surface temperature, relative to room temperature, causes element end 91 to move toward member 84 a distance proportional to the temperature increase. For example, a typical nickel-chrome-steel bimetallic element 0.030 inches thick and having two inches of active length, deflects 0.001040 inches per degree centigrade.

The combination of element 90 and member 84 is attached to bracket 74 so that at room temperature, breaker points 76 and 80 are in electrical contact with each other and bimetallic element end 91 is separated from member 84 by a predetermined distance, *d*. Electrical contact between breaker points 76 and 80 is maintained until element 90 responds to an insulator 38 surface temperature exceeding a predetermined magnitude causing element end 91 to move a distance exceeding d to open breaker points 76 and 80 and disrupt current flow to resistance wire 36. Thus, it is apparent that current flow to resistance wire 36 and operating temperature of styling member outer surface 62 is dependent on the separation, d, between element 84 and bimetallic element end 91.

Variable means for selecting the separation, d, between element 84 and bimetallic element end 91 include a lever 96 pivotally mounted on bracket 74 by a pivot pin, not shown, so that lever end 98 is in contact with member 70. A deflection causing force applied to lever end 100 causes lever 96 to pivotally move to force lever end 98 against spring metal member 70 to vary the separation, *d*, between element 84 and element end 91. Means for applying a deflection causing force against lever end 100 include a control knob 26 formed from electrical insulating material. Control knob 26 is keyed to a threaded member 102 threadedly engaging an internally threaded boss 104 mounted on bracket end 106. Member 70 is normally biased to exert a constant force on lever 96 to assure contact between member 102 and lever 96 and lessen the effect of backlash and looseness in threaded components 102 and 104. A counter clockwise rotation of control knob 26 moves control knob member 102 against lever end 100 to pivotally move lever end 98 against spring metal member 70 causing member 84 to move toward bimetallic element end 91 to provide a relatively small separation, $d_1$, between member 84 and bimetallic end 91. The separation, $d_1$, is selected so that at relatively low insulator 38 surface temperatures, element end 91 moves toward member 84 a distance exceeding $d_1$ to open breaker points 76 and 80. Conversely, a clockwise rotation of control knob 26 permits spring metal member 70 to move against spring metal member 84 to provide a relatively wide separation, $d_2$, between member 84 and bimetallic element end 91. Thus, a relatively high surface temperature is needed to move element end 91 toward member 84 a distance exceeding $d_2$ to open breaker points 76 and 80.

Referring to FIG. 7, there is shown a schematic diagram of the electrical wiring housed in handle 16 for regulating current conduction to resistance wire 36. A voltage signal, V, from a source 111 is coupled across connector terminals 110 and 112. First and second current conducting paths 118 and 120, respectively, are connected in parallel across terminals 110 and 112. The first conductive path 118 includes incandescent lamp 122 serially connected to ballast resistor 124. Lamp 122 is energized in response to a current signal and is visible through a colored lens 124 mounted on handle 16. Thus, energized lamp 122 indicates coupling of electrical energy to styling implement 10.

The second conductive path includes a serial connection of member 84, breaker points 76 and 80, member 70, bracket 74, thermal fuse member 68 and resistance wire 36. In particular, lead 115 is connected from terminal 110 to terminal 86 and since member 84 is electrically coupled to terminal 86, a current conducting path is provided from terminal 110 to breaker point 80 at end 82 of member 84. Breaker point 76 is normally in electrical contact with breaker point 80, bracket 74, and lever 96, as shown in FIG. 5. The outside body of thermal fuse member 68 is formed to be an electrical terminal 126 and is electrically connected to bracket 74 and lever 96 by clamp 128, as shown in FIG. 5. Terminal 130 of thermal fuse 68 is connected to terminal 134 of resistance wire 36 by lead 132. Connector terminal 112 is connected to terminal 136 of resistance wire 36 by lead 117.

Referring to FIGS. 8 and 9, there is shown a broken section of FIG. 2, illustrating a conventional fluid dispensing assembly 20 further described in U.S. Pat. No. 3,835,292. Fluid dispensing assembly 20 includes reservoir member 140, reservoir cap 142, and wick 144. Reservoir member 140 is a hollow structure suitably formed to contain a fluid. As an example, reservoir member 140 is tubular shaped having an externally threaded mouth 148 providing an ingress for fluid. The threaded mouth 148 of member 140 is threadedly engaged by an internally threaded portion 150 of end cap 142. A washer 146 is internally disposed within cap 142 to provide a seal between reservoir member mouth 148 and cap 142. To avoid wetting styling member 12 and the electrical wiring, member 140 is filled with vaporizable fluid, such as water, and then screwed into cap 142 until washer 146 provides a seal between reservoir member mouth 148 and cap 142. An egress for the fluid contained in reservoir member 140 is provided by the wick 144 inserted in an aperture 154 in cap 142 so that wick portion 156 extends inside cap 142 and member 140 and wick portion 158 is external to cap 142. The internally disposed wick portion 156 acts like a sponge to absorb fluid within reservoir member 140 and transfer the absorbed fluid by capillary action to the external wick portion 158.

The fluid dispensing assembly 20 is suitably attached to hair styling implement 10 so that wick portion 158 may be forced against heated heat reservoir 44 to generate steam. For example, fluid dispensing assembly 20 is disposed within a tube-like sleeve 160 force fitted into styling member end 18. Sleeve 160 is suitably arranged to hold cap 142 and wick portion 158 opposite heat reservoir head 46 in substantially coaxial alignment with styling member 12. The bore of sleeve 160 is of sufficient diameter to permit a sliding movement of the fluid dispensing assembly 20 toward heat reservoir head 46. A spring member 166 is inserted in styling member 12 between heat reservoir head 46 and cap 142 to bias or force wick portion 158 away from heat reservoir 44. As shown in FIG. 9, a suitable force applied to reservoir end 141 compresses spring member 166 and moves the fluid saturated wick portion 158 against heat reservoir head 46 to generate a predetermined amount of vapor. The vapor is contained within the void or separation, S, between spacer 34 and heating member 12 and then discharged through the apertures 23, 25, and 28 in heating member 12.

Under operating conditions, the surface 62 of portion 24 is heated to a selected temperature suitable for styling or drying hair. Temperature control knob 26 is arranged to cooperate with the temperature control assembly 34 to vary the surface temperature of portion 24 of styling member 12 from 110° C to 130° C. For example, in styling relatively short, thin hair, requiring low heat, temperature control knob 26 may be set so that the surface temperature of styling member 12 is substantially 110° C. A conventional temperature sensitive crystal 190 which changes color at a predetermined temperature may be mounted on clip 21 to indicate a minimum surface temperature for member 12. Clip 21 is pivoted away from styling member 12 by depressing button end 58. A tress of hair is placed on portion 24 of styling member 12 under clip 21. Button 32 is then released and spring 43 forces clip 21 against the tress of hair and member 12. The clamped tress of hair may be wound around tubular shaped styling member 12 and over clip 21 by rotating the hair styling implement 10 about the longitudinal axis of member 12. If the tress of hair is wet, the heat generated by resistance wire 36 and conducted to portion 24 of styling member 12 drys and sets the hair in a desired curl. The clamped tress of hair is released by depressing button 32 to pivot clip 21 away from member 12. If the tress is dry, the fluid dispensing assembly 20 is operated to provide a vapor suitable for plasticizing the hair to initially set a desired curl in the wound hair. The moisture supplied to the hair by the vapor is removed within a period from 5 to 15 seconds by the heat conducted to the surface of styling member portion 24.

In the preferred embodiment according to the invention, the surface of portion 24 of styling member 12 is maintained at a uniform temperature to uniformly curl a tress of hair. It should be appreciated that the described embodiment using a wick 144 for dispensing fluid from a reservoir member 140 to a heat reservoir 44 to generate a vapor is by way of example. Other elements for dispensing a fluid may be used to implement the invention. Thus, many other arrangements can readily be devised in accordance with the disclosed principle of the invention by those skilled in the art.

What is claimed as new and desired to be secured by Letters Patent of the United States is:

1. Hair Styling apparatus comprising:

a first tubular member having a hair styling portion with first and second ends and a plurality of apertures there between;

a second tubular member having a plurality of nodules arranged in multiple rows and columns about a peripheral surface, said second tubular member being disposed within said first tubular member with said nodules contacting predetermined discrete points (on) substantially at extremities of said hair styling portion of said first tubular member to provide a uniform predetermined spacing between said first and second members and to transfer heat by conduction from said second member to said points on said first member to operate said first tubular member hair styling portion at a predetermined uniform surface temperature;

heat reservoir means attached to one end of said second tubular member;

heat generating means disposed within said second tubular member in heat transfer contact with said heat reservoir means and said second tubular member for heating said hair styling portion to said predetermined uniform surface temperature;

variable temperature control means coupled to said heat generating means for maintaining said hair styling portion at said predetermined temperature;

a handle mounted on a first end of said first tubular member;

fluid dispensing means mounted on a second end of said first tubular member for supplying a predetermined amount of fluid to said heat reservoir means for vaporization, whereby said vaporized fluid is discharged in a radial direction through said apertures; and clamping means pivotally mounted on said handle to clamp hair against said hair styling portion of said first tubular member.

2. Hair styling apparatus according to claim 1, wherein said heat generating means include resistance wire responsive to electrical current.

3. Hair styling apparatus according to claim 2, wherein said resistance wire is embedded in a heat conducting electrical insulator disposed within said second tubular member.

4. Hair styling apparatus according to claim 2, wherein said variable temperature control means include a temperature sensitive element for moving a selected distance in response to a predetermined change in temperature to interrupt a conductive path for said current to said resistance wire and means for determining said selected distance.

5. Hair styling apparatus according to claim 1, wherein said fluid dispensing means include a fluid saturated wick and means for moving said fluid saturated wick to contact said heat reservoir means for vaporizing said fluid in said wick.

6. Hair styling apparatus comprising:

a heat conducting hair styling member having an inner surface and an outer surface with a perforated portion;

heat generating means disposed within said styling member, said heat generating means being responsive to an electrical signal;

means having a plurality of nodules arranged in multiple rows and columns surrounding said heat generating means for conducting heat by conduction from said heat generating means to a plurality of predetermined discrete points on said inner surface of said hair styling member substantially at extremities of said perforated portion to provide a uniform surface temperature along said outer surface of said perforated portion; and fluid dispensing means coupled to said heat conducting styling member for supplying a predetermined amount of fluid to said heat generating means for vaporization, whereas said vaporized fluid is discharged through said apertures.

* * * * *